US005088443A

United States Patent [19]

Hastings et al.

[11] Patent Number: 5,088,443

[45] Date of Patent: Feb. 18, 1992

[54] METHOD AND APPARATUS FOR SPRAYING A LIQUID COATING CONTAINING SUPERCRITICAL FLUID OR LIQUIFIED GAS

[75] Inventors: Donald R. Hastings, Elyria; John A. Hendricks, Vickery, both of Ohio

[73] Assignee: Nordson Corporation, West Lake, Ohio

[21] Appl. No.: 416,855

[22] Filed: Oct. 4, 1989

[51] Int. Cl.[5] ..... B05B 1/00

[52] U.S. Cl. ..... 118/314; 118/300; 239/533 A

[58] Field of Search ..... 118/300, 314; 222/559, 222/567, 575, 529; 239/569, 571, 574, 583, 584, 585; 251/324, 325; 137/501, 504, 503; 234/533.7, 533.9

[56] References Cited

U.S. PATENT DOCUMENTS

| | | | |
|---|---|---|---|
| 2,626,122 | 1/1953 | Lammiman . | |
| 4,059,466 | 11/1977 | Scholl et al. . | |
| 4,059,714 | 11/1977 | Scholl et al. . | |
| 4,156,754 | 5/1979 | Cobbs, Jr. et al. . | |
| 4,200,207 | 4/1980 | Akers et al. . | |
| 4,247,581 | 1/1981 | Cobbs, Jr. et al. . | |
| 4,301,119 | 11/1981 | Cobbs, Jr. et al. . | |
| 4,355,764 | 10/1982 | Rood et al. . | |
| 4,368,852 | 1/1983 | Sharp et al. . | |
| 4,423,161 | 12/1988 | Cobbs, Jr. et al. . | |
| 4,465,212 | 8/1984 | Boone . | |
| 4,497,341 | 8/1983 | Wright | 239/125 |
| 4,505,406 | 3/1985 | Cobbs, Jr. et al. . | |
| 4,505,957 | 3/1985 | Cobbs, Jr. et al. . | |
| 4,527,712 | 7/1985 | Cobbs, Jr. et al. . | |
| 4,553,701 | 11/1985 | Rehman et al. . | |
| 4,579,255 | 4/1986 | Frates | 239/583 |
| 4,608,398 | 8/1986 | Cobbs, Jr. et al. . | |
| 4,630,774 | 12/1986 | Rehman et al. . | |
| 4,632,314 | 12/1986 | Smith et al. . | |
| 4,679,710 | 7/1987 | Jameson et al. . | |
| 4,779,762 | 10/1988 | Klein et al. . | |
| 4,923,720 | 5/1990 | Lee et al. . | |

FOREIGN PATENT DOCUMENTS 0321607 10/1989 European Pat. Off. .

OTHER PUBLICATIONS

Brochure entitled, "Unicarb System for Spray Coatings", of Union Carbide Chemicals and Plastics Company Inc., of Danbury, CT, Jul. 1989.

*Primary Examiner*—David A. Simmons
*Assistant Examiner*—Robert Barker

[57] ABSTRACT

A method and apparatus for spraying liquid coating material containing supercritical fluid or liquified gas as a diluent comprises a spray gun having internal passages which transmit the liquid coating material under high pressure from an inlet to a nozzle at the tip of the gun and then to an outlet so that the liquid coating material can be continuously recirculated. A relatively short flow discharge path is formed between the internal passages in the spray gun and the nozzle to avoid the formation of an area of ambient or reduced pressure so that the supercritical fluid or liquified gas is substantially maintained in solution in the liquid coating until it is discharged from the gun. A pressure regulator is provided to maintain a substantially constant pressure drop across the inlet and outlet of the gun to induce flow of liquid coating material through the gun, and to permit several guns to be connected in series without creating a substantial pressure drop therebetween.

26 Claims, 2 Drawing Sheets

METHOD AND APPARATUS FOR SPRAYING A LIQUID COATING CONTAINING SUPERCRITICAL FLUID OR LIQUIFIED GAS

FIELD OF THE INVENTION

This invention relates to spraying of liquid coatings, and, more particularly, to a method and apparatus for spraying liquid coatings containing supercritical fluid as a diluent.

BACKGROUND OF THE INVENTION

A major problem of the coating and finishing industry, both in terms of raw material usage and environmental effects, concerns the solvent components of paint. In a spray coating application of a resinous material, the resinous material is typically dissolved in an organic solvent to provide a viscosity suitable for spraying. This is required because it has been found that at each stage of the process for atomizing and conveying a resinous material in liquid form to a substrate, the liquid resists high speed deformation. Organic solvents are added to the resinous liquid because they have the effect of separating the molecules of resinous material and facilitating their relative movement making the solution more deformable at high speeds and therefore more susceptible to atomization. Substantial effort has been expended to reduce the volume of liquid solvent components in preparing high solids coating compositions containing above 50% by volume of polymeric and pigmentary solids. Nevertheless, most high solids coating compositions still contain from 15–40% by volume of liquid solvent components.

The problem with such a high volume content of liquid solvents is that during handling, atomization or deposition of the solvent coating compositions, the solvents escape and can become air contaminants if not properly trapped. Once the solvent coating is applied to a substrate, the solvents escape from the film by evaporation and such evaporated solvents also contaminate the surrounding atmosphere. In addition, since most solvents react with oxidants, pollution problems of toxicity, odor and smog may also be created. Attempts at overcoming such environmental problems have proven to be costly and relatively inefficient.

One type of coating process which has been proposed as an alternative to those described above is the "Unicarb" process of Union Carbide Chemicals and Plastics Technology Corporation of Danbury, Conn. The Unicarb process includes the production of a high solids coating composition in which a substantial amount of the liquid solvent component has been removed and replaced with a non-toxic, supercritical fluid such as supercritical carbon dioxide. This coating composition is then sprayed onto a surface at which time the supercritical carbon dioxide "flashes off" or vaporizes to assist in atomization of the high solids coating and to reduce drying time of the composition on the substrate. The term "supercritical" as used herein refers to a gas, which, above its critical pressure and critical temperature, has a density approaching that of a liquid material. Such supercritical fluid is relatively dense and behaves with solvent-like properties. Carbon dioxide is utilized in the Unicarb process because its critical temperature of 88° F. and critical pressure of 1070 psi are within the operating parameters of most airless spray equipment used in coatings applications. The supercritical carbon dioxide and some solvent material, e.g., about two-thirds less than required in other high solids coating compositions, are intermixed with polymeric and pigmentary solids to form a coating composition having a viscosity which facilitates atomization through an airless spray gun. The supercritical carbon dioxide functions as a diluent to enhance the application properties of the paint.

Problems have been encountered in dispensing coating compositions containing supercritical carbon dioxide or liquified gas from conventional spray guns or other dispensers. It has been found that such dispensers permit the supercritical fluid or liquified gas to escape from solution, and/or convert to another phase, prior to discharge of the liquid coating material from the dispenser. Loss of supercritical fluid from the liquid coating composition makes it difficult to atomize the composition because its viscosity increases and also because less supercritical fluid is present to flash off or vaporize as the composition is sprayed to assist in atomization. As a result, the liquid coating tends to sputter or spit upon discharge from the spray gun, does not atomize and thus produces an inferior finish on the substrate to be coated.

SUMMARY OF THE INVENTION

It is therefore among the objectives to provide a method and apparatus for spraying a liquid coating composition, e.g., paint, containing a supercritical fluid or a liquified gas in which the supercritical fluid or liquified gas is maintained in solution within the liquid coating composition throughout passage from the source to and through a spray gun or other dispenser. It is a further objective to provide such a method and apparatus which permits several spray guns to be serially arranged without affecting the spray pattern from any one gun.

These objectives are accomplished in a spray gun including a gun body formed with a throughbore having an inlet adapted to connect to a source of liquid coating material containing supercritical fluid, and an outlet adapted to connect to the inlet of another spray gun. A nozzle is mounted at the tip of the spray gun, and internal passages continuously recirculate liquid coating material from the inlet, to the nozzle and back to the outlet of the gun body. A valve located at the tip of the gun body is operative to permit the flow of liquid coating along a relatively short flow discharge path which interconnects the internal passages of the spray gun with the nozzle.

The construction of the spray gun of this invention is advantageous in a number of respects. In one aspect of this invention, the provision of internal passages within the spray gun to continuously recirculate the liquid coating composition t the tip of the spray gun prevents or substantially eliminates separation of the supercritical fluid or liquified gas from solution. This is particularly advantageous in applications wherein the liquid coating material is heated before delivery to the spray gun. In such instances, recirculation of the liquid coating material through the spray gun substantially prevents it from cooling, and thus lessens the chance of the supercritical fluid being converted from supercritical phase to liquid phase within the spray gun. Any loss of the supercritical fluid from solution increases the difficulty of atomizing the liquid coating composition because of an increase in viscosity of the solution and due to the fact that there is less supercritical fluid available at the point of application to assist in atomization of the paint.

In another aspect of this invention, the relatively short flow discharge path between the internal passages of the spray gun and nozzle is provided to avoid the formation of a zone or area of ambient pressure within the interior of the spray gun. This is desirable because the supercritical fluid or liquified gas contained within the liquid coating is converted to a gas upon exposure to pressures less than that required to maintain the supercritical fluid in solution. In order to maintain the proper viscosity of the liquid coating for atomization, and the availability of sufficient supercritical fluid in solution to assist in atomization, the liquid coating must be maintained under pressure within the gun body of the spray gun until it is discharged from the nozzle.

In the presently preferred embodiment, the structure which defines this relatively short flow discharge path includes a barrel, or extension, mounted to the gun body, which extension supports a fluid tip having a chamber connected to internal passages formed in the extension. The fluid tip is formed with a bore in which a valve seat is mounted. The valve seat has an opening which is opened and closed by movement of a needle valve. The nozzle is mounted to the fluid tip by a holder in a position such that the nozzle and valve seat are located adjacent one another and are separated only by a thin, sealing member or gasket interposed therebetween. A relatively short flow discharge path is therefore provided from the chamber in the fluid tip through the valve seat and gasket and into the nozzle so that a minimal area of ambient pressure is created within the spray gun which would permit the supercritical fluid to leave solution and enter the gaseous phase. As a result, the viscosity of the liquid coating remains substantially the same throughout its passage within the spray gun, and most of the supercritical fluid is available for atomization of the liquid coating composition upon discharge from the nozzle onto a substrate.

In another aspect of this invention, the gun body is provided with means to control the pressure drop between the inlet and outlet of the throughbore in the gun body regardless of whether the needle valve is in an open or closed position. Control of the pressure drop across the gun body is needed in applications in which a number of spray guns are connected in series, i.e., wherein the outlet of one spray gun is connected to the inlet of an adjacent spray gun.

In the presently preferred embodiment, a regulator is employed to control the pressure drop between the inlet and outlet which comprises a plunger located midway between the inlet and outlet of the throughbore. A plurality of circumferentially spaced grooves or slots are formed in the outer surface of the plunger having a combined cross sectional area which is approximately equal to the cross sectional area of the throughbore. The plunger is connected to a regulator spring carried on its downstream side, and is movable in an axial direction with respect to the inlet of the throughbore in the gun body against the force applied by the regulator spring.

In response to a pressure drop across the inlet and outlet of the throughbore, e.g., caused by opening the valve at the tip of the gun body, the plunger is axially movable relative to the inlet of the throughbore to control the pressure at the outlet thereof. This ensures that the pressure at the inlet of the throughbore is always slightly higher than the pressure at the outlet to induce movement of liquid coating material through the spray gun. In addition, the plunger prevents a substantial pressure drop between the inlet and outlet so that the pressure of the liquid coating exiting the outlet of one spray gun and entering the inlet of an adjacent spray gun is approximately the same to ensure uniform spray patterns are applied by each gun.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
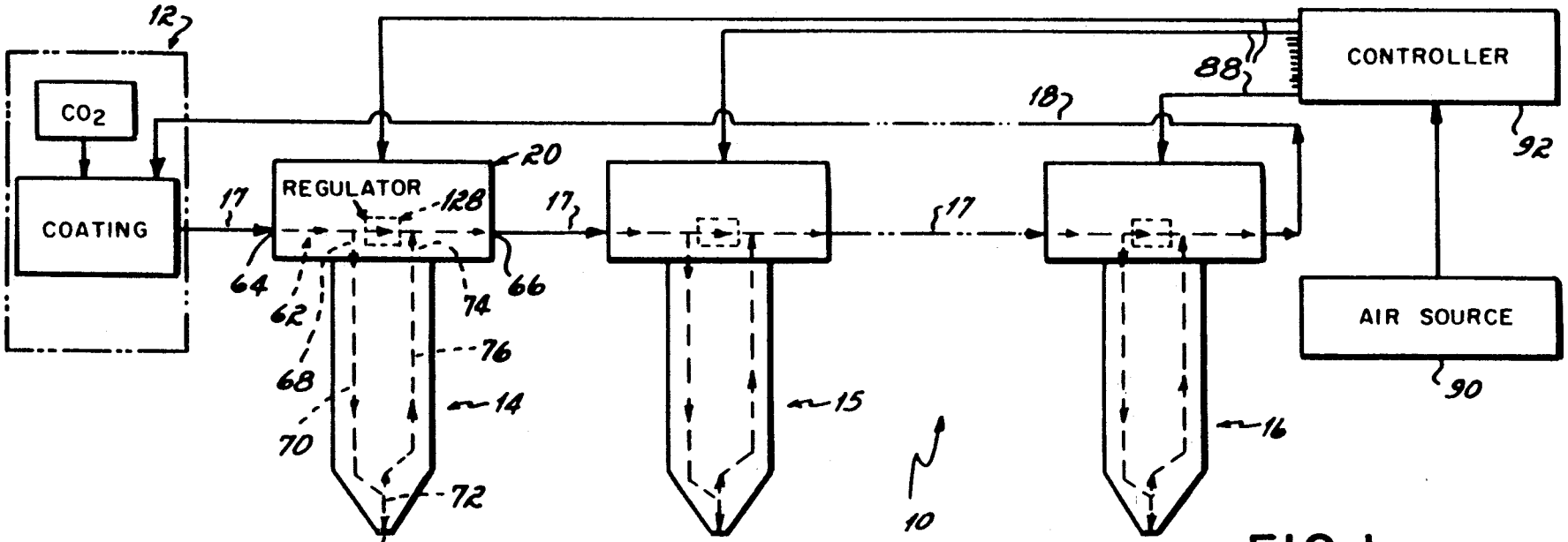
FIG. 1 is a schematic view of an array of spray guns of this invention arranged serially.

Referring now to FIG. 1, a spraying system 10 is illustrated comprising a source 12 of liquid coating material containing a supercritical fluid which is connected to a number of spray guns 14, 15 and 16 interconnected in series. The term "supercritical fluid" as used herein is intended to refer to a gas in a state above its critical pressure and critical temperature wherein the gas has a density approaching that of a liquid material. It is also contemplated that liquified gases could be utilized in place of supercritical fluids as a diluent for the liquid coating material. A number of compounds in a supercritical or liquified state can be intermixed with the liquid coating material, e.g., paint, to produce a solution which can be dispensed in an atomized spray onto a substrate with the system 10 of this invention. These compounds include carbon dioxide, ammonia, water, nitrogen oxide ($N_2O$), methane, ethane, ethylene, propane, pentane, methanol, ethanol, isopropanol, isobutanol, chlorotrifluoromethane, monofluoromethane and others.

One presently preferred solution includes liquid coating material containing supercritical carbon dioxide of the type sold in connection with the "Unicarb" system of the Union Carbide Chemicals and Plastics Technology Corporation of Danbury, Conn. In the Unicarb system, supercritical carbon dioxide is maintained in solution in the liquid coating under suitable temperature and pressure conditions. This solution is supplied from the source 12 to each of the spray guns 14–16 through several supply lines 17, and then back to the source 12 through a return line 18 connected to spray gun 16. One aspect of this invention is directed to a method and apparatus for spraying the liquid coating containing supercritical carbon dioxide.

Figure 2:
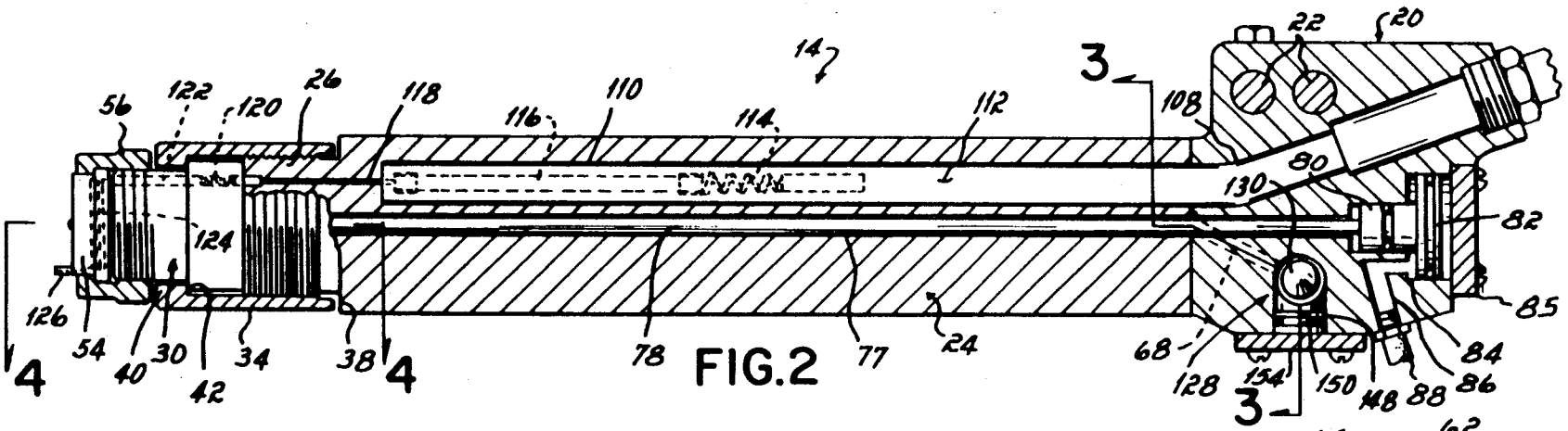
FIG. 2 is a side elevational view, in partial cross section, of the spray gun herein.
Figure 4:
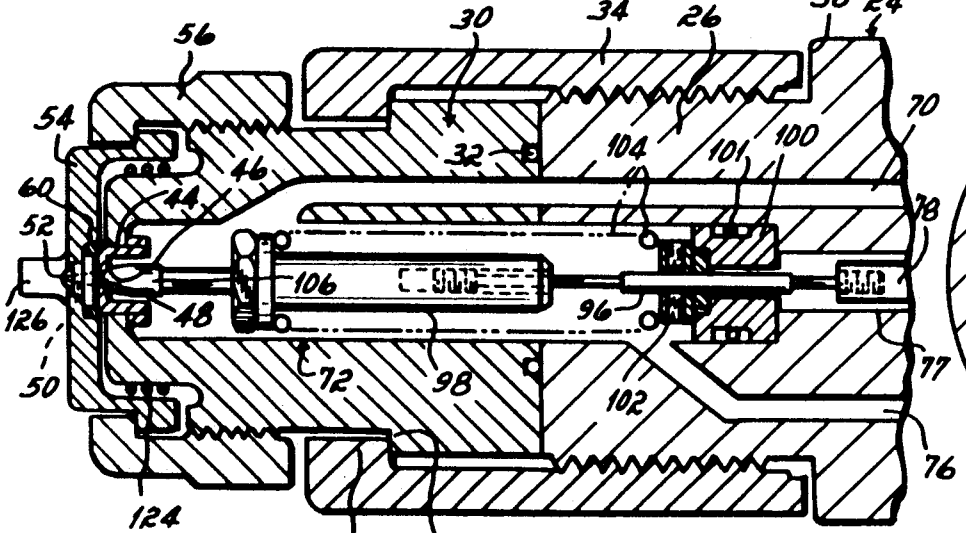
FIG. 4 is a cross sectional view of the tip portion of the spray gun taken generally along line 4—4 of FIG. 2.

Referring to FIGS. 2 and 4, the structure of spray gun 14 is illustrated in detail, it being understood that spray guns 15 and 16 are identical in structure and function to spray gun 14. Spray gun 14 comprises a gun body 20 formed with bores which carry mounting rods 22 for supporting the gun body 20 in a spraying position. The gun body 20 mounts an elongated barrel or extension 24 having a reduced diameter end 26 formed with external threads. A fluid tip 30 is mounted to the end of extension 24, with a face seal O-ring 32 therebetween, by an annular retainer 34 having internal threads which mate with the external threads of the extension 24. In assembled position, the forward end of the retainer 34 engages a shoulder 42 formed in the fluid tip 30. As used herein, the term "forward" refers to the discharge end of the spray gun, i.e., the lefthand side of FIGS. 2 and 4, and the term "rearward" refers to the inlet end of the spray gun 14, i.e., the righthand side of FIGS. 2 and 4.

The forward end of the fluid tip 30 is formed with a bore 44 which mounts a valve seat 46 having an opening 48. This opening 48 aligns with the throughbore 50 of a nozzle 52 which is mounted to the forward end of fluid tip 30 by a nozzle holder 54 and a nozzle cap 56. The nozzle 52 is press fit into a stepped bore formed in the nozzle holder 54 which also mounts a sealing member such as a gasket 60 on the rearward side of the nozzle 52 as viewed in FIG. 4. The nozzle holder 54 is secured in position at the forward end of fluid tip 30 by the nozzle cap 56 which threads onto the outer wall of the fluid tip 30. As shown in FIG. 4, a relatively short fluid flow path is formed between the opening 48 in the valve seat 46 and the throughbore 50 of nozzle 52, with the space therebetween being sealed by the gasket 60, as discussed below.

Figure 3:
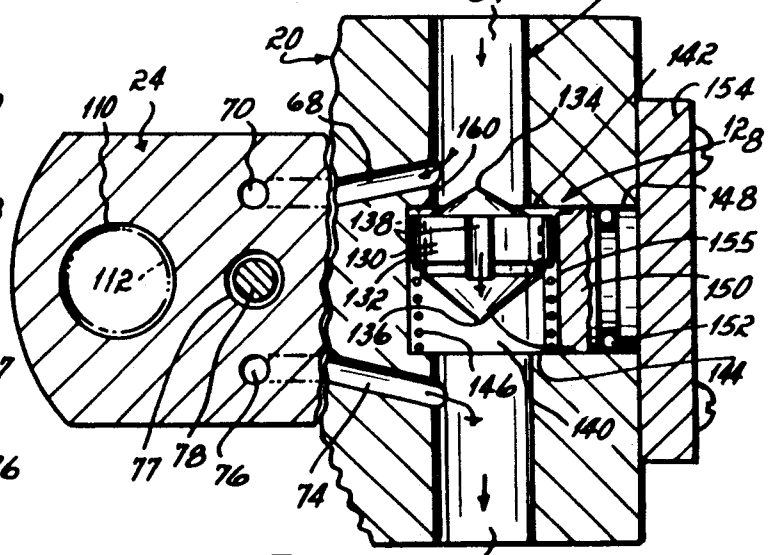
FIG. 3 is a cross sectional view of the spray gun taken generally along line 3—3 of FIG. 2 illustrating the pressure regulator herein.

Referring to FIGS. 1, 3 and 4, the gun body 20 is formed with a throughbore 62 having an inlet 64 connected by supply line 17 to the source 12 of liquid coating, and an outlet 66 connected by another supply line 17 to the spray gun 15, or, as in gun 16, to the return line 18. The gun body 20 is formed with a relatively small diameter infeed connector passage 68 which extends between the throughbore 62 and a delivery passage 70 formed in the extension 24. The delivery passage 70 continues from the extension 24 through the fluid tip 30 to a fluid chamber 72 formed at the forward end of the fluid tip 30. The gun body 20 is also formed with a second, small diameter return connector passage 74 which is connected at one end to the throughbore 62 downstream from the inlet passage 68, and at the other end to a return passage 76 formed in the extension 24. The return passage 76 extends from the gun body 20 to the forward end of the extension 24 in communication with the fluid chamber 72 in the fluid tip 30.

The above-described passages, all of which have a diameter of about 0.125 inches, form a path for the circulation of liquid coating material from the gun body 20 to the tip of the spray gun 14. Liquid coating containing supercritical carbon dioxide or a liquified gas is directed under pressure into the inlet 64 of the throughbore 62. As described in more detail below, a major portion of this flow passes through the throughbore 62 and a relatively small portion of such flow enters the connector passage 68 in the gun body 20. The liquid coating flows from the connector passage 68, through the delivery passage 70 and into the fluid chamber 72 at the tip or forward end of the spray gun 14. The liquid coating which is not ejected through the nozzle 52, as discussed below, flows from the fluid chamber 72 into the return passage 76 and then through the second connector passage 74 to the outlet 66 of throughbore 62. Recirculation of the liquid coating material containing supercritical fluid through the spray gun 14 is desirable to avoid the supercritical fluid from leaving solution in either supercritical or gaseous phase within the spray gun 14.

The relatively small size of the internal passages in spray gun 14, and particularly passages 70 and 76, is advantageous in two respects. First, such small diameter passages 70, 76 substantially prevent the buildup of pressure within the gun body 20 which potentially could blow off the structure at its forward end considering that the liquid coating composition containing supercritical fluid or liquified gas is transmitted to and through the spray gun 14 under high pressure, e.g., about 1500 psi. Additionally, the small diameter passages 70, 76 provide an electrical standoff between the electrostatic charging structure at the forward end of spray gun 14, described below, and the rearward end of the spray gun 14 which initially receives the liquid coating material and which is electrically grounded.

In order to discharge the liquid coating in atomized form from the spray gun 14, structure is provided to open and close the opening 48 in the valve seat 46 of the fluid tip 30. As best shown in FIGS. 2 and 4, a stepped throughbore 77 is formed in the gun body 20 and extension 24 which carries a pull shaft 78 movable axially therealong. The rearward end of the pull shaft 78 mounts a piston 80 connected to a head plate 82 carried within an air chamber 84 formed in the gun body 20 which is closed on its rearward side by a cover plate 85. An air supply passage 86 is formed in the gun body 20 which extends to the air chamber 84 on the forward side of the head plate 82. This air supply passage 86 is connected to a line 88 from a source of pressurized air 90 connected to a controller 92. See also FIG. 1. The controller 92 is operative to supply pressurized air through the line 88 and supply passage 86 into the air chamber 84 to cause the head plate 82 and pull shaft 78 to move in a rearward direction toward a cover plate 85.

The pull shaft 78 is connected by a coupler 96 to a packing cartridge tip 98 located in the fluid chamber 72 formed in the fluid tip 30. As shown in FIG. 4, both ends of the coupler 96 are threaded to permit adjustment of the axial position of the packing cartridge tip 98 relative to the pull shaft 78. The coupler 96 extends through a guide 100 mounted by a seal 101 at the forward end of the extension 24, and a packing seal 102 is interposed between the guide 100 and fluid chamber 72 to create a fluid-tight seal therebetween. A return spring 104 extends between the forward end of the packing cartridge tip 98 and the packing seals 102. A needle valve 106 is mounted to the forward end of the packing cartridge tip 98 which is engageable with the valve seat 46 over its opening 48.

In response to the supply of pressurized air into the air chamber 84 as described above, the pull shaft 78, packing cartridge tip 98, and needle valve 106 are all moved in a rearward direction, thus unseating the needle valve 106 from the valve seat 46. This permits the flow of liquid coating from the fluid chamber 72 along a relatively short flow discharge path defined by the opening 48 in valve seat 46, the thin gasket 60 and the throughbore 50 of nozzle 52. Such relatively short flow discharge path substantially prevents the formation of an area or zone of ambient or reduced pressure within the spray gun 14. Because the liquid coating containing supercritical carbon dioxide or liquified carbon dioxide is thus maintained under substantial pressure within the spray gun 14, the discharge of the liquid coating through nozzle 52 causes it to atomize and the supercritical carbon dioxide or liquified carbon dioxide immediately "flashes off" or enters the gaseous phase upon exposure to ambient pressure outside of the spray gun 14 and nozzle 52. That portion of the liquid coating material supplied to the fluid chamber 72 in fluid tip 30 by the delivery passage 70 which does not enter the nozzle 52 is recirculated through the return passage 76 into the throughbore 62 in the gun body 20. In order to move the needle valve 106 into a closed position with respect to the valve seat 46, the pressurized air within air chamber 84 is exhausted by operation of a three-way valve (not shown) to allow the return spring 104 to force the packing cartridge tip 98 and needle valve 106 forwardly so that the needle valve 106 engages the valve seat 46.

In the presently preferred embodiment, the atomized, liquid coating material which is discharged from the nozzle 52 is electrostatically charged at the forward end of the spray gun 14. The structure for imparting an electrostatic charge to the atomized liquid coating material is shown in FIGS. 2 and 3. The gun body 20 is formed with a bore 108 which aligns with a bore 110 formed in the extension 24. These bores 108, 110 receive a high voltage electrostatic cable 112 having a terminal end which extends about midway along the extension 24. A connector spring 114 is electrically connected at one end to the cable 112 and at the opposite end to the lead of a high value resistor 116, e.g., a resistor rated at about 175 megaohms. This high value resistor 116 is electrically connected by a conducting pin 118 to a second connector spring 120 mounted in the fluid tip 30. The connector spring 120, in turn, is connected to a tip resistor 122 of relatively low value, e.g., about 20 megaohms.

With reference to FIGS. 2 and 4, the tip resistor 122 is electrically connected to a spring electrode 124. The spring electrode 124 extends around the outer wall of the forward end of fluid tip 30 and has one electrode wire 126 which projects forwardly from the fluid tip 30 and nozzle 52. This electrode wire 126 creates an electrostatic field at the forward end of the spray gun 14 into which the atomized liquid coating is discharged from the nozzle 52 so that an electrostatic charge is imparted to the atomized coating material for deposition on a substrate.

In another aspect of this invention, structure is provided to permit spray guns 14, 15 and 16 to be interconnected in series with one another without a significant pressure drop from one gun to another. This ensures that the spray pattern of liquid coating discharged from each spray gun 14–16 is substantially the same.

Figure 5:
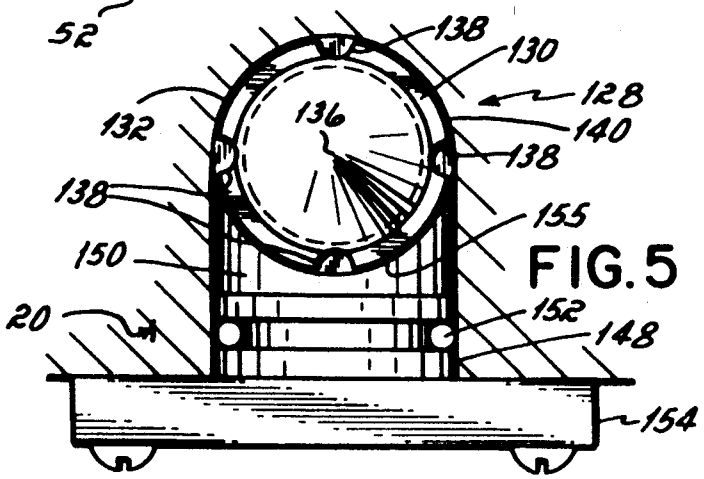
FIG. 5 is an enlarged view of the regulator herein.

With reference to FIGS. 2, 3 and 5, the pressure drop from the inlet 64 of throughbore 62 to its outlet 66 is maintained substantially constant by a regulator 128. The regulator 128 comprises a plunger 130 having an outer ring 132 and opposed flow control tips 134, 136. The outer ring 132 of plunger 130 is formed with four circumferentially spaced, axially extending slots 138 which, in the presently preferred embodiment, have a combined cross sectional area substantially equal to the cross sectional area of the throughbore 62 at its inlet 64 and/or outlet 66. While four slots 138 are illustrated in the Figs., it should be understood that essentially any number of slots could be employed provided their combined cross sectional area is substantially equal to the cross sectional area of throughbore 62.

As shown in FIG. 5, the plunger 130 is carried within a plunger cavity 140, having a larger diameter than the throughbore 62, which is formed in the gun body 20 midway along the throughbore 62 between the first and second connector passages 68, 74, respectively. The cavity 140 forms opposed shoulders 142 and 144 at its opposite ends, and a regulator spring 146 extends between the outer ring 132 of plunger 30 and the shoulder 144. Preferably, a transverse bore 148 is formed in the gun body 20 which intersects the plunger cavity 140. An access plug 150 is inserted within the bore 148 and sealed therein by an O-ring 152 and a cover plate 154 mounted to the gun body 20. The inner end of the access plug 150 has a concavely arcuate surface 155 that matches or coincides with the curvature of the plunger cavity 140. The purpose of the access plug 150 is to permit insertion and removal of the regulator 128 from the plunger cavity 140 as desired.

The regulator 128 functions to control the pressure drop between the inlet 64 and outlet 66 of throughbore 62. Regardless of the position of the needle valve 106, most of the flow of liquid coating material passes directly through the throughbore 62 and only a relatively small portion of the flow enters the extension 24. The purpose of the regulator 128 is twofold. It maintains a nominal pressure drop between the inlet 64 and outlet 66 of throughbore 62 to induce at least some flow of the coating material into the extension 24 through first connector passage 68. In addition, the regulator 128 ensures that the pressure drop between the inlet 64 and outlet 66 remains substantially constant when the needle valve 106 opens and closes so that the pressure of the liquid coating material supplied by spray gun 14 to spray gun 15 is substantially the same as the pressure of the liquid coating material supplied by the coating source 12 to the spray gun 14.

The regulator 128 operates as follows. When the needle valve 106 is in a closed position, all of the liquid coating material which enters the delivery passage 70 of extension 24 must be recirculated through return passage 76 to the outlet 66 of throughbore 62. Because all of the flow must be recirculated, a relatively large pressure drop tends to be created between the inlet 64 of throughbore 62 and its outlet 66. That is, the pressure at the inlet 64 tends to be higher than the pressure at the outlet 66. In order to lessen the pressure drop between opposite ends of the throughbore 62, and thus between the first and second connector passages 68, 74, the plunger 130 of the regulator 128 is forced downstream, i.e., to the right as viewed in FIG. 3, which compresses the regulator spring 146. This has the effect of enlarging the space 160 between the flow control tip 134 of plunger 130 and the shoulder 142 at the upstream end of the cavity 140. The flow path thereby created through the regulator 128 achieves a small pressure drop across the regulator 128 and thus reduces, but does not eliminate, the pressure drop between the inlet 64 and outlet 66 ends of throughbore 62.

When the needle valve 106 is moved to an open position, the pressure at the outlet 66 decreases because a portion of the liquid coating material flowing through the extension 24 is discharged through the nozzle 52 and not as much must be recirculated through the spray gun 14. In order to maintain a substantially constant pressure drop between the inlet 64 and outlet 66 in the valve open condition, the plunger 130 restricts the passage of liquid coating into the cavity 140. That is, the spring 146 forces the plunger 130 toward the shoulder 142 as viewed in FIG. 5, thus reducing the space 160 between the flow control tip 134 of plunger 130 and the shoulder 142 of cavity 140.

Each of the spray guns 14, 15 and 16 includes a regulator 128 for minimizing the pressure drop across the throughbore 62. As a result, no significant pressure drop is obtained between adjacent spray guns 14–16 and the pressure of the liquid coating material supplied to the inlet 64 of one spray gun is substantially equal to the pressure of the liquid coating material supplied to the inlet 64 of an adjacent spray gun. This ensures that the spray pattern from each spray gun 14–16 is substantially the same.

The embodiment illustrated in FIG. 1 involves the construction of spray guns 14–16 wherein the regulator 128 is contained within the interior of the spray guns 14–16. It is contemplated, however, that the regulator 128 need not be an integral part of such spray guns 14–16 but could be physically separated therefrom.

Figure 6:
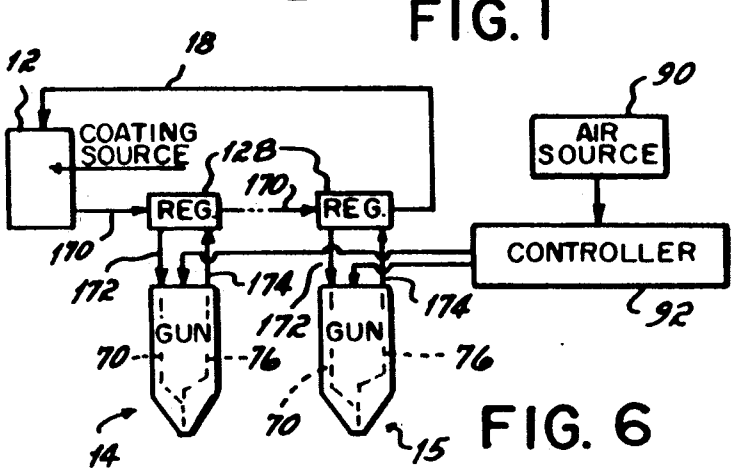
FIG. 6 is a view similar to FIG. 1 in which the regulator is mounted outside of each spray gun.

Referring now to FIG. 6, an alternative embodiment is illustrated in which two regulators 128, one for each spray gun 14 and 15 (and gun 16 not shown), are connected to a common feed line 170 from a source 12 of liquid coating material containing supercritical fluid or liquified gas. These regulators 128 are structurally and functionally identical to the regulator 128 described above. A connector line 172 extends from the inlet of each regulator 128 to the delivery passage 70 in each spray gun 14, 15, and a return connector line 174 extends between the return passage 76 in spray guns 14, 15 to the outlet of a regulator 128. The regulators 128 operate in the same manner as discussed above in controlling the pressure drop across their respective inlets and outlets, to induce a flow of liquid coating material into spray guns 14, 15 and to control the pressure drop across the delivery passage 70 and return passage 76 thereof. Similarly, the air source 90, controller 92 and return line 18 in the embodiment of FIG. 6 function in the same manner as in the embodiment of FIGS. 1–5.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the regulator 128 is shown in a position within cavity 140 wherein the flow control tip 134 faces upstream and the larger flow control tip 136 faces downstream. It is contemplated that the position of these flow control tips 134, 136 could be reversed, with regulator spring 146 being retained in position against shoulder 144, to accommodate other flow rate and/or pressure conditions. Alternatively, a new regulator 128 and/or regulator spring 146 can be inserted within the cavity 140 by removing the cover plate 154 and access plug 150 to accommodate still other flow rate and pressure conditions.

Therefore, it is intended that the invention not be limited to the particular embodiment disclosed as the best mode contemplated for carrying out this invention, but that the invention will include all embodiments falling within the scope of the appended claims.

We claim:

1. Apparatus for spraying a liquid coating material containing supercritical fluid or liquified gas, comprising:

a dispensing device formed with an inlet and an outlet, said inlet being adapted to connect to a source of the liquid coating material containing supercritical fluid or liquified gas;

a nozzle having a discharge bore, said nozzle being carried by said dispensing device;

said dispensing device being formed with passage means for transmitting the liquid coating material containing supercritical fluid or liquified gas from said inlet, to said nozzle and then to said outlet at sufficient pressure so that the supercritical fluid or liquified gas is maintained in solution in the liquid coating material within said dispensing device;

means for transmitting the liquid coating material containing supercritical fluid or liquified gas from said passage means into said nozzle so that the supercritical fluid or liquified gas is maintained substantially in solution in the liquid coating material before being emitted through said discharge bore of said nozzle for application onto a substrate.

2. The apparatus of claim 1 in which said passage means comprises a fluid chamber formed in said dispensing device in communication with said nozzle, a delivery passageway extending between said inlet and said fluid chamber and a return passageway extending between said fluid chamber and said outlet whereby the liquid coating material containing supercritical fluid or liquified gas is recirculated through said dispensing device from said inlet, through said delivery passageway to said fluid chamber at said nozzle and then from said fluid chamber through said return passageway to said outlet so that the supercritical fluid or liquified gas is maintained in solution in the liquid coating material.

3. The apparatus of claim 1 in which said means for transmitting the liquid coating material containing supercritical fluid or liquified gas from said passage means into said nozzle comprises:

a fluid tip carried by said dispensing device, said fluid tip being formed with an opening;

a valve seat having a throughbore, said valve seat being mounted within said opening in said fluid tip;

a nozzle holder having a bore which mounts said nozzle, said nozzle holder being mounted to said fluid tip so That said throughbore in said valve seat communicates with said discharge bore in said nozzle;

a sealing member positioned between said nozzle and said valve seat to create a seal therebetween;

valve means movable to an open position with respect to said valve seat for permitting the flow of the liquid coating material containing supercritical fluid along a flow discharge path extending from said passage means, through said throughbore in said valve seat and said sealing member into said nozzle, the supercritical fluid being maintained substantially in solution in the liquid coating material in the course of passage along said flow discharge path before the liquid coating material is ejected from said discharge bore in said nozzle.

4. Apparatus for spraying a liquid coating material containing supercritical fluid, comprising:

a dispensing device formed with a bore having an inlet adapted to receive the liquid coating material containing supercritical fluid and an outlet;

a nozzle carried by said dispensing device, said nozzle having a discharge bore;

said dispensing device being formed with a delivery passage connected to said bore and a return passage connected to said bore, said delivery passage and said return passage each communicating with said nozzle for transmitting liquid coating material containing supercritical fluid from said inlet, to said nozzle and then to said outlet so that the supercritical fluid is maintained in solution in the liquid coating material within said dispensing device;

a fluid tip carried by said dispensing device, said fluid tip being formed with a fluid chamber connected to said delivery passage and to said return passage, said fluid tip being formed with an opening extending into said fluid chamber;

a valve seat having a throughbore, said valve seat being mounted in said opening in said fluid tip;

a nozzle holder having a bore which mounts said nozzle, said nozzle holder being mounted to said fluid tip so that said discharge bore in said nozzle aligns with said throughbore in said valve seat;

a seal member positioned between said nozzle and said valve seat to create a seal therebetween;

valve means movable between an open position to permit the flow of the liquid coating material containing supercritical fluid from said delivery passage into said fluid chamber, through said valve seat and sealing member and into said nozzle, and a closed position to prevent the flow of the liquid coating material containing supercritical fluid into said nozzle.

5. Apparatus for spraying a liquid coating material containing supercritical fluid, comprising:

a dispensing device formed with an inlet and an outlet, said inlet being adapted to connect to a source of the liquid coating material containing supercritical fluid;

a nozzle having a discharge bore, said nozzle being carried by said dispensing device;

said dispensing device being formed with passage means for transmitting the liquid coating material containing supercritical fluid from said inlet, to said nozzle and then to said outlet at sufficient pressure so that the supercritical fluid is maintained in solution in the liquid coating material within said dispensing device;

means for interconnecting said passage means and said nozzle so that the supercritical fluid is maintained substantially in solution in the liquid coating material in the course of passage from said passage means into said nozzle, the supercritical fluid leaving solution and being converted to gaseous phase upon discharge of the liquid coating material from said discharge bore in said nozzle.

6. The apparatus of claim 5 in which said passage means comprises a fluid chamber formed in said dispensing device in communication with said nozzle, a delivery passageway extending between said inlet and said fluid chamber and a return passageway extending between said fluid chamber and said outlet whereby the liquid coating material containing supercritical fluid is recirculated through said dispensing device from said inlet, through said delivery passageway to said fluid chamber at said nozzle and then from said fluid chamber through said return passageway to said outlet so that the supercritical fluid or liquified gas is maintained in solution in the liquid coating material.

7. The apparatus of claim 5 in which said means for interconnecting said passage means and said nozzle comprises:

a fluid tip carried by said dispensing device, said fluid tip being formed with an opening;

a valve seat having a throughbore, said valve seat being mounted within said opening in said fluid tip;

a nozzle holder having a bore which mounts said nozzle, said nozzle holder being mounted to said fluid tip so that said throughbore in said valve seat communicates with said discharge bore in said nozzle;

a sealing member positioned between said nozzle and said valve seat to create a seal therebetween;

valve means movable to an open position with respect to said valve seat for permitting the flow of the liquid coating material containing supercritical fluid along a flow discharge path extending from said passage means, through said throughbore in said valve seat and said sealing member into said nozzle, the supercritical fluid being maintained substantially in solution in the liquid coating material in the course of passage along said flow discharge path before the liquid coating material is ejected from said discharge bore in said nozzle.

8. Apparatus for spraying a liquid coating material, comprising:

a dispensing device formed with a bore having an inlet adapted to receive the liquid coating material and an outlet;

a nozzle carried by said dispensing device, said nozzle having a discharge bore;

said dispensing device being formed with passage means for transmitting a portion of the liquid coating material entering said bore of said dispensing device from said inlet of said bore, to said nozzle and then to said outlet of said bore;

valve means movable between an open position for permitting flow of the liquid coating material from said passage means into said nozzle, and a closed position for preventing flow of the liquid coating material into said nozzle;

means carried within said bore between said inlet and outlet thereof for creating a pressure drop between said inlet and outlet of said bore to induce a flow of the liquid coating material into said passage means.

9. Apparatus for spraying a liquid coating material, comprising:

supply means formed with a bore having an inlet adapted to receive liquid coating material and an outlet adapted to discharge the liquid coating material;

a dispensing device formed with an inlet and an outlet;

means interconnecting said inlet of a supply means with said inlet of said dispensing device and for interconnecting said outlet of said supply means with said outlet of said dispensing device;

a nozzle carried by said dispensing device, said nozzle having a discharge bore;

said dispensing device being formed with passage means for transmitting liquid coating material from said inlet thereof, to said nozzle and then through said outlet of said dispensing device to said supply means;

valve means movable between an open position for permitting flow of the liquid coating material from said passage means into said nozzle, and a closed position for preventing flow of the liquid coating material into said nozzle;

means carried within said bore of said supply means between said inlet and outlet thereof for maintaining a substantially constant pressure drop between said inlet and outlet of said bore and between said inlet and outlet of said dispensing device regardless of whether said valve means of said dispensing device is in an open position or a closed position.

10. The apparatus of claim 8 in which said bore in said dispensing device is formed with an enlarged diameter portion having first and second shoulders at opposite ends thereof, said means carried within said bore for creating a pressure drop comprising:

a plunger having an outer wall and opposed ends, one of said ends being formed with a flow control tip which faces said inlet of said bore and said first shoulder of said enlarged diameter portion of said bore;

a regulator spring connected between said outer end of said plunger and said second shoulder, said regulator spring being effective to control the axial position of said plunger within said enlarged diameter portion of said bore relative to said first shoulder in response to changes in pressure between said inlet and outlet of said bore.

11. The apparatus of claim 10 in which said outer wall of said plunger is formed with circumferentially spaced grooves which permit the passage of liquid coating material therethrough, said grooves having a combined cross sectional area which is approximately equal to the cross sectional area of said bore.

12. Apparatus for spraying a liquid coating material, comprising:

a dispensing device formed with a bore having an inlet adapted to receive the liquid coating material and an outlet, said bore being formed with an increased diameter portion between said inlet and outlet thereof;

a nozzle carried by said dispensing device, said nozzle having a discharge bore;

said dispensing device being formed with a delivery passage connected to said bore between said inlet and said increased diameter portion thereof, and a return passage connected to said bore between said outlet and said increased diameter portion thereof, said delivery passage and said return passage each communicating with said nozzle;

valve means movable between an open position for permitting flow of the liquid coating material from said delivery passage into said nozzle, and a closed position for preventing flow of the liquid coating material into said nozzle;

regulator means axially movable within said enlarged diameter portion of said bore for maintaining a substantially constant pressure drop between said inlet and outlet of said bore and between said delivery and return passage regardless of whether said valve means is in an open position or a closed position.

13. The apparatus of claim 12 in which first and second shoulders are formed at opposite ends of said enlarged diameter portion of said bore, said regulator means comprising:

a plunger having an outer wall and opposed ends, one of said ends being formed with a flow control tip which faces said inlet of said bore and said first shoulder of said enlarged diameter portion of said bore;

a regulator spring connected between said outer end of said plunger and said second shoulder, said regulator spring being effective to control the axial position of said plunger within said enlarged diameter portion of said bore relative to said first shoulder in response to changes in pressure between said inlet and outlet of said bore.

14. The apparatus of claim 13 in which said outer wall of said plunger is formed with circumferentially spaced grooves which permit the passage of liquid coating material therethrough, said grooves having a combined cross sectional area which is approximately equal to the cross sectional area of said bore.

15. Apparatus for spraying a liquid coating material containing supercritical fluid, comprising:

a dispensing device formed with a bore having a inlet adapted to receive the liquid coating material and an outlet, said bore being formed with an increased diameter portion between said inlet and outlet thereof;

a nozzle carried by said dispensing device, said nozzle having a discharge bore;

said dispensing device being formed with a delivery passage connected to said bore between said inlet and said increased diameter portion thereof, and a return passage connected to said bore between said outlet and said increased diameter portion thereof, said delivery passage and said return passage each communicating with said nozzle for transmitting liquid coating material containing supercritical fluid from said inlet, to said nozzle and then to said outlet so that the supercritical fluid is maintained in solution in the liquid coating material within said dispensing device;

means for interconnecting said delivery passage and said return passage with said nozzle so that the supercritical fluid is maintained substantially in solution in the liquid coating material in the course of passage from said delivery passage into said nozzle;

valve means movable between an open position to permit the flow of the liquid coating material containing supercritical fluid from said delivery passage into said nozzle, and a closed position to prevent the flow of the liquid coating material containing supercritical fluid into said nozzle;

regulator means axially movable within said enlarged diameter portion of said bore for maintaining a substantially constant pressure drop between said inlet and outlet of said bore and between said delivery and return passages regardless of whether said valve means is in an open position or a closed position.

16. The apparatus of claim 15 in which said means for interconnecting said delivery passage and said return passage with said nozzle comprises:

a fluid tip carried by said dispensing device, said fluid tip being formed with a fluid chamber connected to said delivery passage and to said return passage, said fluid tip being formed with an opening extending into said fluid chamber;

a valve seat having a throughbore, said valve seat being mounted in said opening in said fluid tip;

a nozzle holder having a bore which mounts said nozzle, said nozzle holder being mounted to said fluid tip so that said discharge bore in said nozzle aligns with said throughbore in said valve seat; and a seal member positioned between said nozzle and said valve seat to create a seal therebetween.

17. The apparatus of claim 15 in which said passage means comprises a delivery passage connected to said bore between said inlet and said enlarged diameter portion thereof, and a return passage connected to said bore between said outlet and said enlarged diameter portion thereof, said delivery passage and said return passage each extending from said bore into communication with said nozzle.

18. The apparatus of claim 15 in which first and second shoulders are formed at opposite ends of said enlarged diameter portion of said bore, said regulator means comprising:

a plunger having an outer wall and opposed ends, one of said ends being formed with a flow control tip which faces said inlet of said bore and said first shoulder of said enlarged diameter portion of said bore;

a regulator spring connected between said outer end of said plunger and said second shoulder, said regulator spring being effective to control the axial position of said plunger within said enlarged diameter portion of said bore relative to said first shoulder in response to changes in pressure between said inlet and outlet of said bore.

19. The apparatus of claim 18 in which said outer wall of said plunger is formed with circumferentially spaced grooves which permit the passage of liquid coating material therethrough, said grooves having a combined cross sectional area which is approximately equal to the cross sectional area of said bore.

20. Apparatus for spraying a liquid coating material, comprising:

a dispensing device formed with a bore having an inlet adapted to receive the liquid coating material and an outlet;

a nozzle carried by said dispensing device, said nozzle having a discharge bore;

said dispensing device being formed with passage means for transmitting a portion of the liquid coating material entering said bore o said dispensing device from said inlet of said bore, to said nozzle and then to said outlet of said bore;

valve means movable between an open position for permitting flow of the liquid coating material from said passage means into said nozzle, and a closed position for preventing flow of the liquid coating material into said nozzle;

means carried within said bore between said inlet and outlet thereof for maintaining a substantially constant pressure drop between said inlet and outlet of said bore regardless of whether said valve means is in an open position or a closed position.

21. The apparatus of claim 10 in which said passage means comprises a delivery passage connected to said bore between said inlet thereof and said regulator means, and a return passage connected to said bore between said outlet thereof and said regulator means, said delivery passage and said return passage each extending from said bore into communication with said nozzle.

22. Apparatus for spraying a liquid coating material containing liquified gas, comprising:

a dispensing device formed with an inlet and an outlet, said inlet being adapted to connect to a source of the liquid coating material containing liquified gas;

a nozzle having a discharge bore, said nozzle being carried by said dispensing device;

said dispensing device being formed with passage means for transmitting the liquid coating material containing liquified gas from said inlet, to said nozzle and then to said outlet at sufficient pressure so that the liquified gas is maintained in solution in the liquid coating material within said dispensing device;

means for transmitting the liquid coating material containing liquified gas from said passagae means into said nozzle so that the liquified gas is maintained substantially in solution in the liquid coating material before being emitted through said discharge bore of said nozzle for application onto a substrate.

23. Apparatus for spraying a liquid coating material, comprising:

supply means formed with a bore having an inlet adapted to receive liquid coating material and an outlet adapted to discharge the liquid coating material;

a dispensing device formed with an inlet and an outlet;

means interconnecting said inlet of said a supply means with said inlet of said dispensing device, and for interconnecting said outlet of said supply means with said outlet of said dispensing device;

a nozzle carried by said dispensing device, said nozzle having a discharge bore;

said dispensing device being formed with passage means for transmitting liquid coating material from said inlet thereof, to said nozzle and then to said outlet of said dispensing device;

valve means movable between an open position for permitting flow of the liquid coating material from said passage means into said nozzle, and a closed position for preventing flow of the liquid coating material from said passage means into said nozzle;

means carried within said bore of said supply means between said inlet and outlet thereof for creating a pressure drop between said inlet and outlet of said bore to induce a flow of liquid coating material onto said passage means of said dispensing device.

24. The apparatus of claim 23 in which said bore in said supply means is formed with an enlarged diameter portion having first and second shoulders at opposite ends thereof, said means carried within said bore of said supply means comprising:

a plunger having an outer wall and opposed ends, one of said ends being formed with a flow control tip which faces said inlet of said bore and said first shoulder of said enlarged diameter portion of said bore;

a regulator spring connected between said outer end of said plunger and said second shoulder, said regulator spring being effective to control the axial position of said plunger within said enlarged diameter portion of said bore relative to said first shoulder in response to changes in pressure between said inlet and outlet of said bore.

25. The apparatus of claim 24 in which said outer wall of said plunger is formed with circumferentially spaced grooves which permit the passage of liquid coating material therethrough, said grooves having a combined cross sectional area which is approximately equal to the cross sectional area of said bore.

26. Apparatus for spraying a liquid coating material containing liquified gas, comprising:

a dispensing device formed with a bore having an inlet adapted to receive the liquid coating material containing liquified gas and an outlet, said bore being formed with an increased diameter portion between said inlet and outlet thereof;

a nozzle carried by said dispensing device, said nozzle having a discharge bore;

said dispensing device being formed with a delivery passage connected to said bore between said inlet and said increased diameter portion thereof, and a return passage connected to said bore between said outlet and said increased diameter portion thereof, said delivery passage and said return passage each communicating with said nozzle for transmitting liquid coating material containing liquified gas from said inlet, to said nozzle and then to said outlet so that the liquified gas is maintained in solution in the liquid coating material within said dispensing device;

means for interconnecting said delivery passage and said return passage with said nozzle so that the liquified gas is maintained substantially in solution in the liquid coating material in the course of passage from said delivery passage into said nozzle;

valve means movable between an open position to permit the flow of the liquid coating material containing liquified gas from said delivery passage into said nozzle, and a closed position to prevent the flow of the liquid coating material containing liquified gas into said nozzle;

regulator means axially movable within said enlarged diameter portion of said bore for maintaining a substantially constant pressure drop between said inlet and outlet of said bore and between said delivery and return passages regardless of whether said valve means is in an open position or a closed position.

* * * * *